US011641073B2

(12) United States Patent
Tanaka et al.

(10) Patent No.: US 11,641,073 B2
(45) Date of Patent: May 2, 2023

(54) CONNECTOR

(71) Applicant: Japan Aviation Electronics Industry, Limited, Tokyo (JP)

(72) Inventors: Yukitaka Tanaka, Tokyo (JP); Yuki Suda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/407,307

(22) Filed: Aug. 20, 2021

(65) Prior Publication Data

US 2022/0115796 A1 Apr. 14, 2022

(30) Foreign Application Priority Data

Oct. 12, 2020 (JP) ..... JP2020-171682
Oct. 12, 2020 (JP) ..... JP2020-171688

(51) Int. Cl.
*H01R 12/71* (2011.01)
*H01R 13/627* (2006.01)
*H01R 12/70* (2011.01)
*H01R 12/79* (2011.01)

(52) U.S. Cl.
CPC ..... *H01R 12/716* (2013.01); *H01R 12/7005* (2013.01); *H01R 12/79* (2013.01); *H01R 13/6273* (2013.01); *H01R 13/6275* (2013.01)

(58) Field of Classification Search
CPC .. H01R 12/716; H01R 12/79; H01R 13/6581; H01R 13/6271; H01R 13/6272; H01R 13/6594; H01R 24/60; H01R 12/7005; H01R 13/6273; H01R 13/6275
See application file for complete search history.

(56) References Cited

U.S. PATENT DOCUMENTS 10,069,244 B2 9/2018 Neu et al.
10,601,181 B2 3/2020 Lu et al.
11,146,025 B2 * 10/2021 Lu ..... H01R 13/6581
2019/0067854 A1 * 2/2019 Ju ..... H01R 13/46

FOREIGN PATENT DOCUMENTS

TW M565895 U 8/2018
TW M595343 U 5/2020

OTHER PUBLICATIONS

Taiwanese Office Action dated Nov. 23, 2022 in Taiwanese Application No. 110131238 with English Translation.

* cited by examiner

*Primary Examiner* — Gary F Paumen
(74) *Attorney, Agent, or Firm* — Collard & Roe, P.C.

(57) ABSTRACT

A housing of a connector has an end face in a perpendicular direction perpendicular to an up-down direction. A side portion of a guide member is apart from the end face of the housing. The end face of the housing, the side portion of the guide member and supporting portions of the guide member form a receiving portion which guides and receives a protruding block of a mating connector. When the connector is mounted on a substrate, the side portion and the supporting portions are apart from the substrate. Outside the end face of the housing in the perpendicular direction and under the side portion and the supporting portions in the up-down direction, a lower space is formed to communicate with the receiving portion. The guide members 16 is not located in the lower spaces 20 at all.

5 Claims, 12 Drawing Sheets

CONNECTOR

CROSS REFERENCE TO RELATED APPLICATIONS

This application is based on and claims priority under 35 U.S.C. § 119 to Japanese Patent Application No. JP2020-171682 filed Oct. 12, 2020 and No. JP2020-171688 filed Oct. 12, 2020, the contents of which are incorporated herein in their entirety by reference.

BACKGROUND OF THE INVENTION

The present invention relates to a connector to be mounted on a substrate, in particular, to a connector provided with a guide member for guiding a mating connector.

U.S. Pat. No. 10,601,181 (Patent Document 1) discloses an example of a connector to be mounted on a substrate, wherein the connector has a guide member. As understood from FIG. 19, a connector 90 of Patent Document 1 is mounted on an upper surface of a substrate (not shown) in an up-down direction and mateable with and detachable from a mating connector 95.

As shown in FIG. 19, the mating connector 95 has a terminal board 951 and an adjacent wall 953. Each of the terminal board 951 and the adjacent wall 953 protrudes downward in the up-down direction. The terminal board 951 is provided with a plurality of mating contacts (not shown). The adjacent wall 953 is located near the terminal board 951 to be apart therefrom in a direction perpendicular to the up-down direction.

As shown in FIG. 19, the connector 90 has an insulator body (housing) 92 and a metal housing (guide member) 94. The insulation body 92 defines a receiving space 921 which receives the terminal board 951 of the mating connector 95. The receiving space 921 opens upward. The insulation body 92 holds a plurality of contacts 923. Each of the contacts 923 is exposed in the receiving space 921 in part. The metal housing 94 surrounds the insulation body 92 in a plane perpendicular to the up-down direction. The metal housing 94 defines an adjacent groove 941 which receives the adjacent wall 953 of the mating connector 95 together with a side surface of the insulation body 92. The metal housing 94 is provided with a plurality of leg portions 943 which is fixed to the substrate when the connector 90 is mounted on the substrate (not shown).

SUMMARY OF THE INVENTION

The connector 90 of Patent Document 1 is mounted on a mounting surface of the substrate. Here, in order to improve mounting density of the substrate, there is a need to improve area utilization efficiency of the mounting surface.

It is therefore an object of the present invention to provide a connector which can improve area utilization efficiency of a mounting surface of a substrate.

One aspect of the present invention provides a connector which is mateable with a mating connector along an up-down direction. The connector is to be mounted on a substrate in the up-down direction. The mating connector comprises a mating contact portion and a protruding block. The protruding block protrudes along the up-down direction. The protruding block is provided with a mating locking portion. The connector comprises at least one terminal, a housing, at least one guide member and a locking portion. The terminal has a contact portion. The contact portion is brought into contact with the mating contact portion in a mated state that the connector and the mating connector are mated with each other. The housing holds the terminal. The housing has an end face in a perpendicular direction perpendicular to the up-down direction. The locking portion locks the mated state together with the mating locking portion. The guide member has a side portion and two supporting portions supporting the side portion. The side portion is located apart from the end face of the housing in the perpendicular direction. The end face of the housing, the side portion of the housing and the supporting portions of the housing form a receiving portion which guides and receives the protruding block when the connector and the mating connector are mated with each other. The side portion and the supporting portions are located apart from the substrate when the connector is mounted on the substrate. Outside the end face of the housing in the perpendicular direction and under the side portion and the supporting portions in the up-down direction, a lower space is formed to communicate with the receiving portion. The guide member is not located in the lower space.

The connector of the present invention is provided with the housing and the guide member. The guide member corresponds to the end face of the housing. The guide portion has the side portion and the two supporting portions. The side portion and the two supporting portions form the receiving portion together with the end face corresponding thereto. The receiving portion guides and receives the protruding block of the mating connector. When the connector is mounted on the substrate, the side portion and the supporting portions are apart from the substrate to form the lower space under the side portion and the supporting portions. In the connector 90 of Patent Document 1, the leg portions 943 cause dead spaces. In contrast, in the present invention, no guide member is located in the lower space. With this structure, a mounting surface of the substrate facing the lower space can be used efficiently, and thereby area utilization efficiency of the mounting surface of the substrate can be improved.

An appreciation of the objectives of the present invention and a more complete understanding of its structure may be had by studying the following description of the preferred embodiment and by referring to the accompanying drawings.

Figure 1:
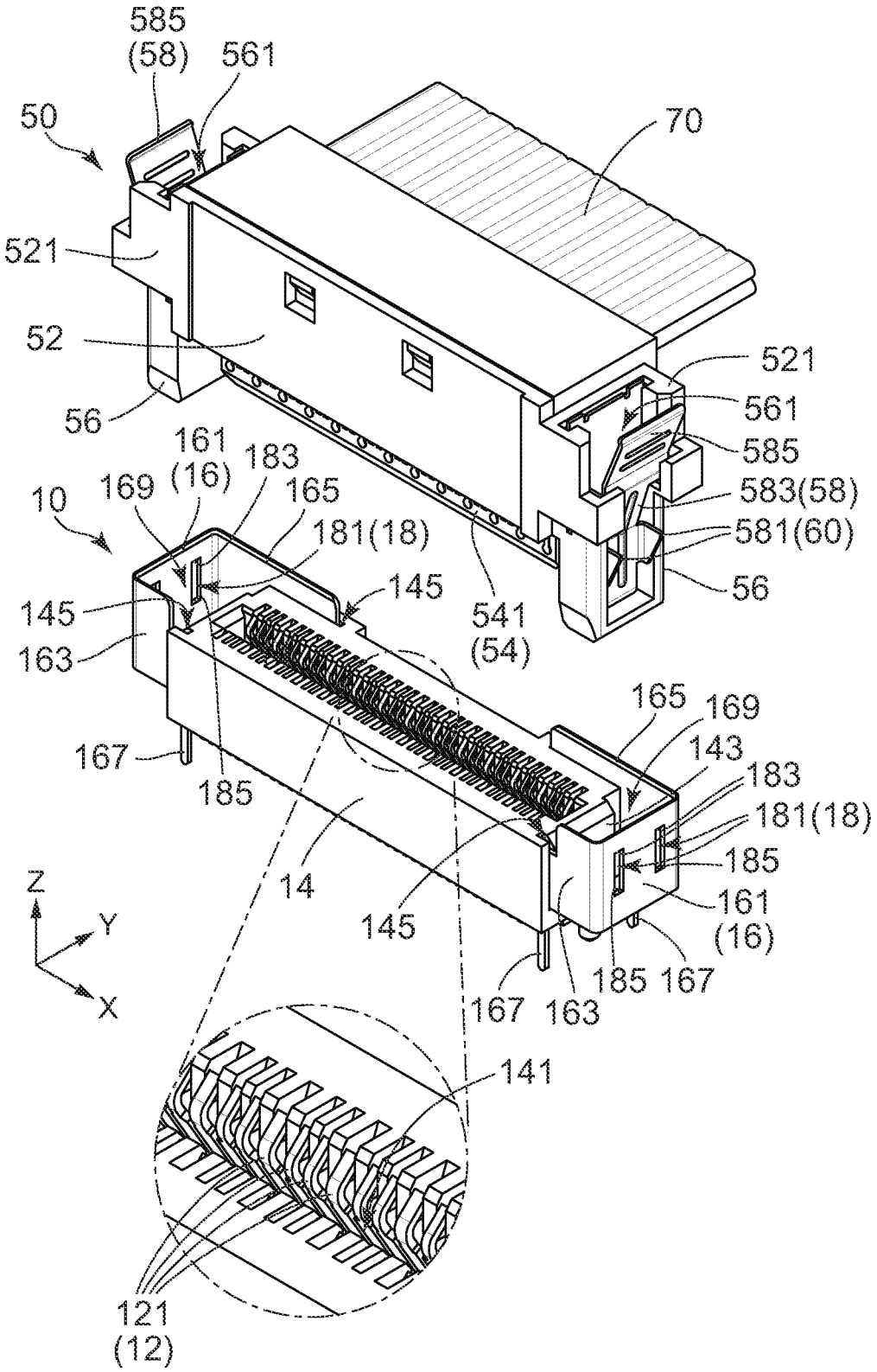
FIG. 1 is a perspective view showing a connector assembly including a connector according to a first embodiment of the present invention. The connector and a mating connector are separated from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As understood from FIGS. 1 to 4, a connector 10 according to a first embodiment of the present invention is a connector which is mateable with and removable from a mating connector 50 along an up-down direction. In the present embodiment, the connector 10 is a receptacle connector while the mating connector 50 is a plug connector. The connector 10 is mounted on one surface of a substrate 80 in the up-down direction when used. In the present embodiment, the up-down direction is a Z-direction. A positive Z-direction is directed upward while a negative Z-direction is directed downward.

As shown in FIGS. 1. 5 and 6, in the present embodiment, the mating connector 50 is an angle-type connector connected to an end of a flexible flat cable 70. However, the present invention is not limited thereto. The mating connector 50 may be a straight-type connector. Moreover, the mating connector 50 may be connected to a multi-core cable or may be mounted on a mating substrate.

Figure 3:
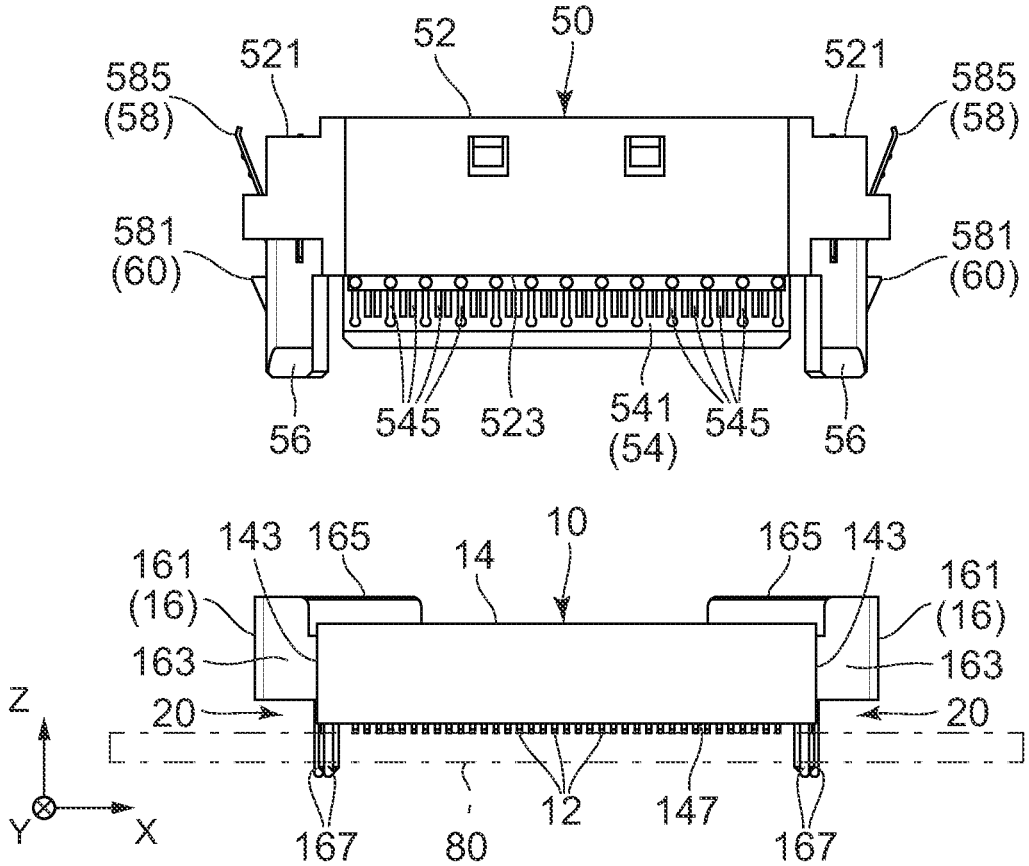
FIG. 3 is a front view showing the connector assembly of FIG. 1.
Figure 5:
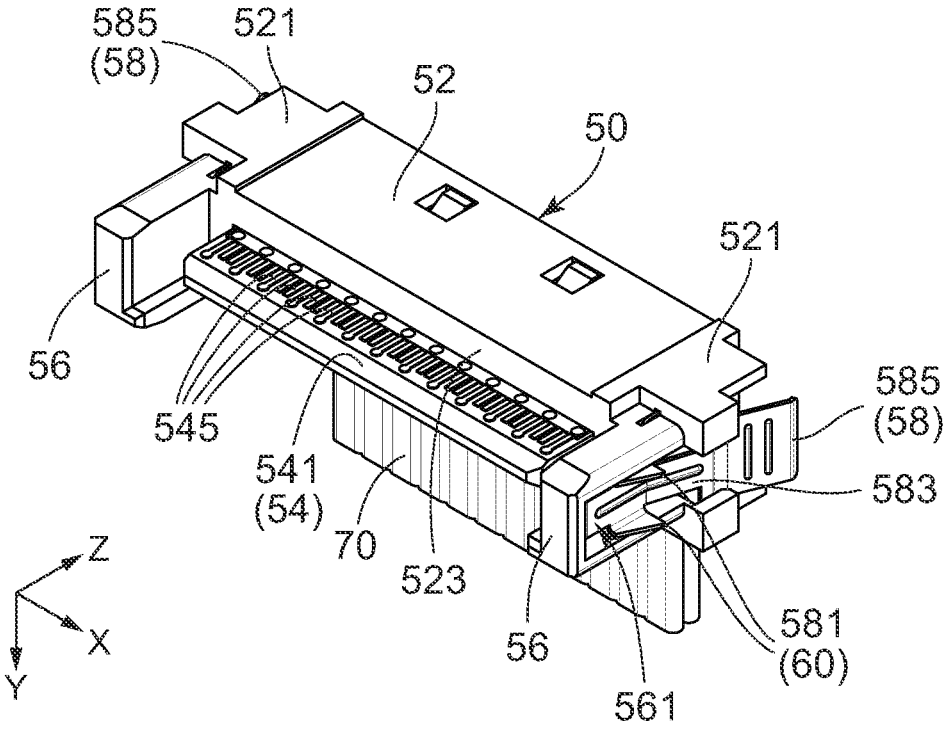
FIG. 5 is a bottom perspective view showing the mating connector included in the connector assembly of FIG. 1.

As shown in FIGS. 3 and 5, the mating connector 50 is provided with a housing body 52, a tongue-shaped portion 54, at least one protruding block 56 and at least one locking spring 58. In the present embodiment, the mating connector 50 is provided with two protruding blocks 56 and two locking springs 58.

Figure 6:
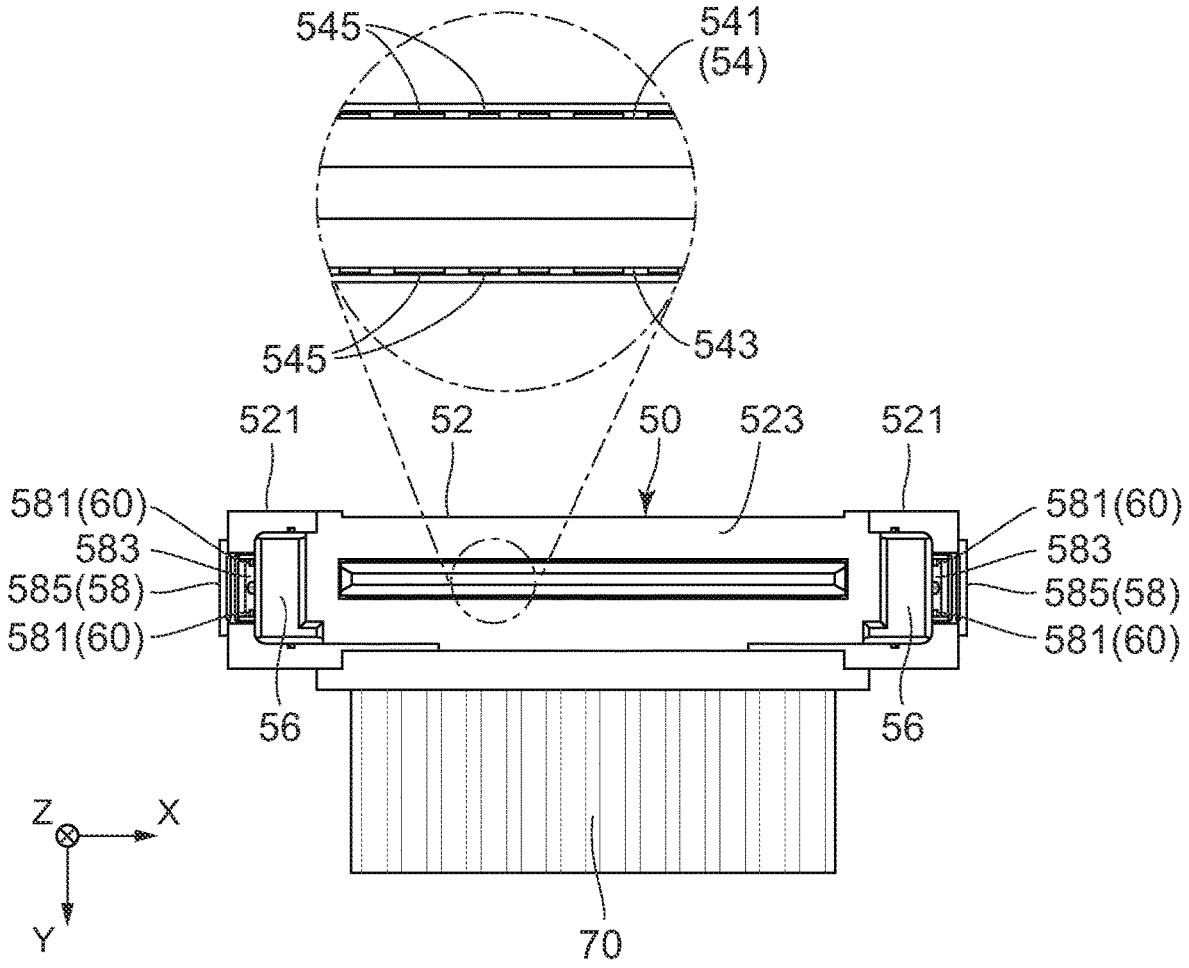
FIG. 6 is a bottom view showing the mating connector of FIG. 5.

As understood from FIGS. 1, 3 and 6, the housing body 52 is made of insulation resin and has an approximately rectangular parallelepiped shape long in a pitch direction. The housing body 52 has locking-spring-holding portions 521 at both ends thereof in the pitch direction. In the present embodiment, the pitch direction is an X-direction.

As shown in FIGS. 3 and 5, the tongue-shaped portion 54 extends in the pitch direction and protrudes downward from a lower surface 523 of the housing body 52. As shown in FIG. 6, each of a front surface 541 of the tongue-shaped portion 54 and a rear surface 543 of the tongue-shaped portion 54 is formed with a plurality of mating contact portions 545 arranged along the pitch direction. In detail, the mating contact portions 545 are conductor pads formed on an insulation substrate. However, the present invention is not limited thereto. The mating connector 50 may be provided with a plurality of metal terminals as a substitute for the tongue-shaped portion 54. At any rate, the mating connector 50 is provided with at least one mating contact portion 545.

As shown in FIGS. 3, 5 and 6, the protruding blocks 56 are located apart from each other in the pitch direction. The protruding blocks 56 correspond to the locking-spring-holding portions 521 of the housing body 52, respectively. Each of the protruding blocks 56 protrudes from the locking-spring-holding portion 521 corresponding thereto along the up-down direction. In the present embodiment, the protruding block 56 protrudes downward from the locking-spring-holding portion 521 corresponding thereto. Each of the protruding blocks 56 and the locking-spring-holding portion 521 corresponding thereto define a locking-spring-accommodation portion 561 which opens outward in the pitch direction and upward.

As shown in FIGS. 1 and 5, the locking springs 58 are accommodated in the locking-spring-accommodation portions 561, respectively, in part. In the present embodiment, each of the locking springs 58 is made from a metal sheet and has a pair of stops 581, a supporting portion 583 and an operation portion 585. The supporting portion 583 supports the stops 581 and is resiliently deformable at least in part. Each of the stops 581 protrudes outward in the pitch direction. The operation portion 585 is provided to an end of the supporting portion 583. By operating the operation portion 585, the supporting portion 583 can be resiliently deformed. Resilient deformation of the supporting portion 583 allows the stops 581 to be moved at least in the pitch direction. In an initial state, tip ends of the stops 581 are located outside the locking-spring-accommodation portion 561. The stops 581 of each of the locking springs 58 function as a mating locking portion 60. Thus, each of the protruding blocks 56 is provided with the mating locking portion 60.

Figure 7:
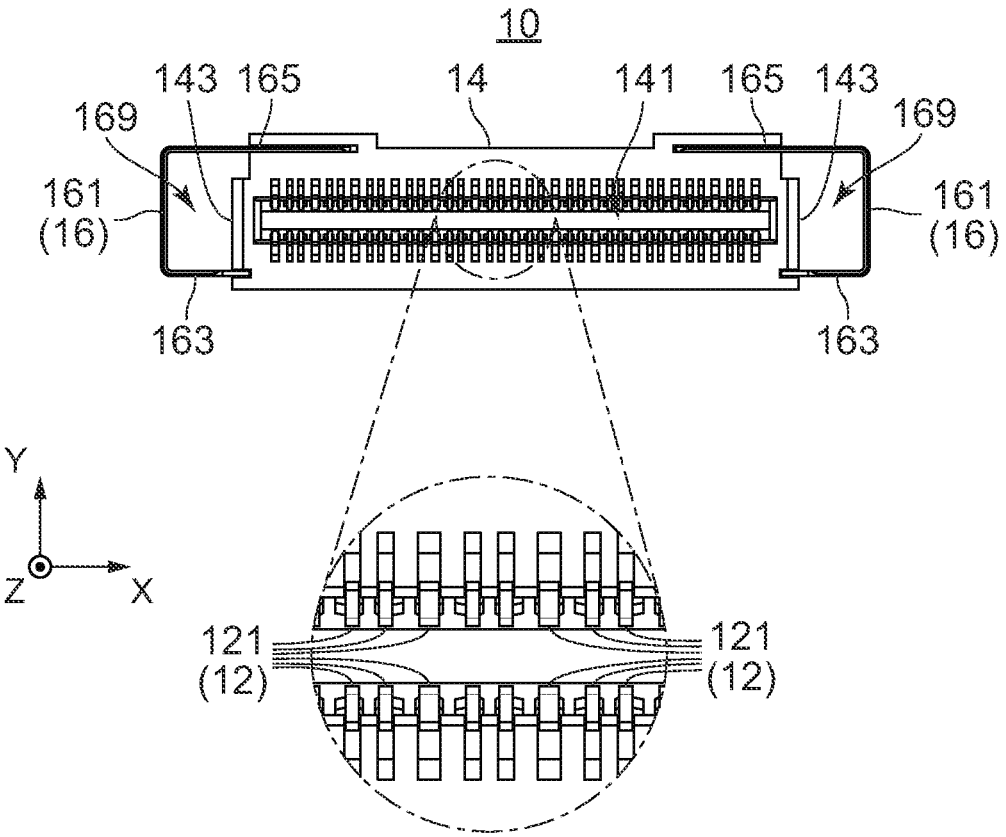
FIG. 7 is a top view showing the connector included in the connector assembly of FIG. 1.
Figure 8:
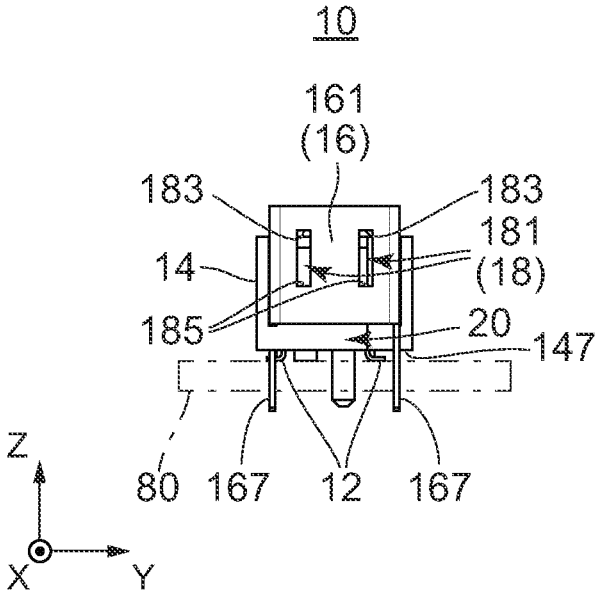
FIG. 8 is a side view showing the connector of FIG. 7.

Referring to FIGS. 1, 7 and 8, the connector 10 is provided with at least one terminal 12, a housing 14, at least one guide member 16 and at least one locking portion 18. In the present embodiment, the connector 10 is provided with a plurality of terminals 12. Moreover, in the present invention, the connector 10 has two guide members 16 and two locking portions 18.

As shown in FIG. 7, the terminals 12 are arranged in the pitch direction. In the present embodiment, the terminals 12 are arranged in two rows along the pitch direction. However, the present invention is not limited thereto. The terminals 12 correspond to the mating contact portions 545, respectively, and an arrangement of the terminals 12 depends on an arrangement of the mating contact portions 545. For example, the terminals 12 may be arranged in a single row in the pitch direction according to the arrangement of the mating contact portions 545.

As shown in FIGS. 1 and 7, each of the terminals 12 has a contact portion 121, which is brought into contact with the mating contact portion 545 (see FIG. 3 or 5) in a mated state that the connector 10 and the mating connector 50 are mated with each other. In the present embodiment, each of the terminals 12 is a spring contact made of metal. However, the present invention is not limited thereto. In a case where the mating contact portion 545 is a spring contact made of metal, the terminal 12 may be a conductor pad formed on an insulation substrate.

As understood from FIG. 7, the housing 14 holds the terminals 12. The housing 14 has an approximately rectangular parallel piped shape long in the pitch direction and defines an accommodation space 141 which opens upward. Each of the terminals 12 is exposed in the accommodation space 141 in part. In detail, at least the contact portion 121 is exposed in the accommodation space 141.

Figure 9:
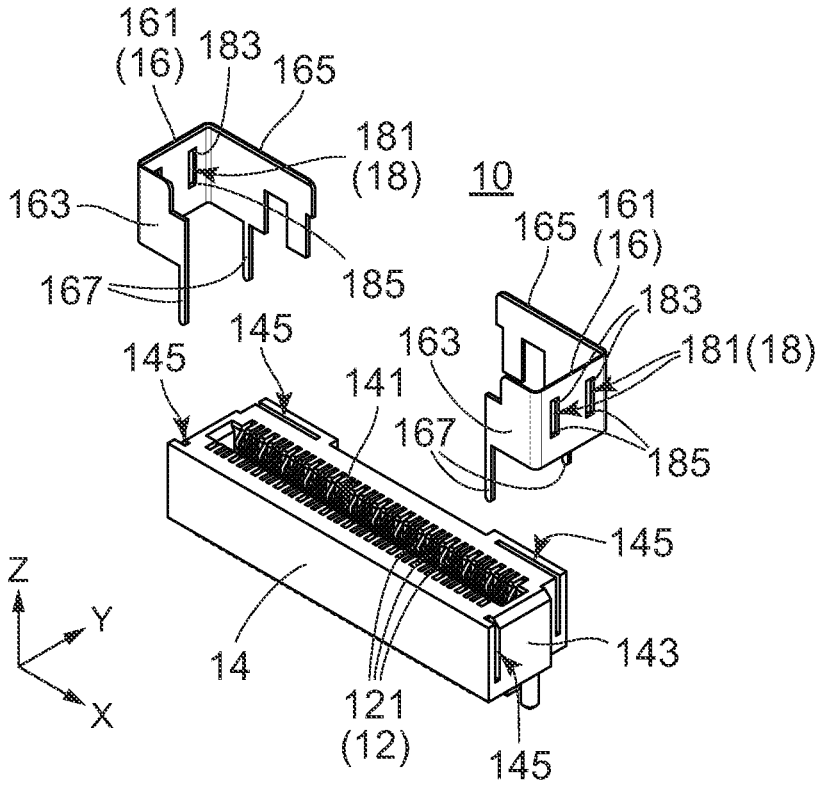
FIG. 9 is an exploded, perspective view showing the connector of FIG. 7.

As shown in FIGS. 7 and 9, the housing 14 has end faces 143 in a perpendicular direction perpendicular to the up-down direction. In the present embodiment, the perpendicular direction is identical with the pitch direction. In the present embodiment, the housing 14 has the end faces 143 at both ends thereof in the pitch direction. The end faces 143 of the housing 14 correspond to the protruding blocks 56 (see FIG. 3) of the mating connector 50, respectively. In the present embodiment, each of the end faces 143 is a surface directed outward in the pitch direction.

As shown in FIG. 9, the housing 14 is formed with a plurality of slits 145 to be attached with the guide members 16 and with a plurality of holes (not shown) contiguous to the slits 145. In the present embodiment, each of the slits 145 opens upward and outward in the pitch direction. However, the present invention is not limited thereto. The slit 145 may open only upward according to a shape of the guide member 16 or only outward in the pitch direction.

As understood from FIG. 9, the two guide members 16 are separate and distinct from each other. In the present embodiment, the guide members 16 has shapes which are mirror images of each other. However, the present invention is not limited thereto. The guide members 16 may have the same shapes or different shapes, provided that the guide members 16 correspond to the protruding blocks 56 of the mating connector 50.

As shown in FIGS. 9 to 12, in the present embodiment, each of the guide members 16 is made from a metal sheet and has a side portion 161 and two supporting portions 163 and 165 supporting the side portions 161. The side portion 161 is a flat plate perpendicular to the pitch direction. Each of the supporting portions 163 and 165 is a flat plate extending inward in the pitch direction from an edge of the side portion 161 in a front-rear direction. In the present embodiment, the front-rear direction is a Y-direction. A negative Y-direction is directed forward while a positive Y-direction is directed rearward.

Figure 10:
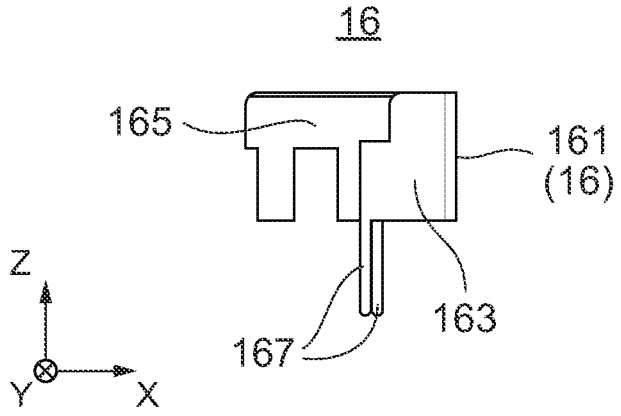
FIG. 10 is a front view showing one of guide members included in the connector of FIG. 9.
Figure 11:
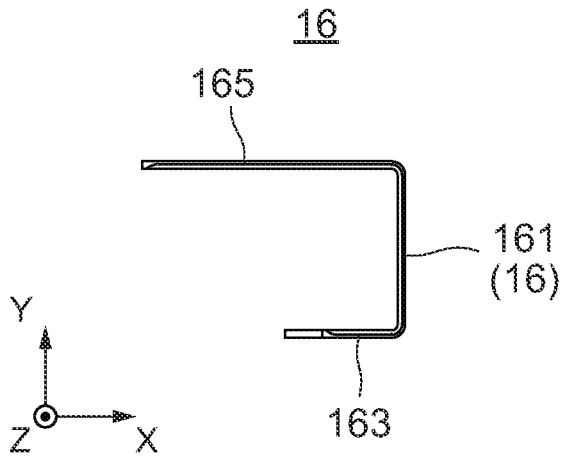
FIG. 11 is a top view showing the guide member of FIG. 10.
Figure 12:
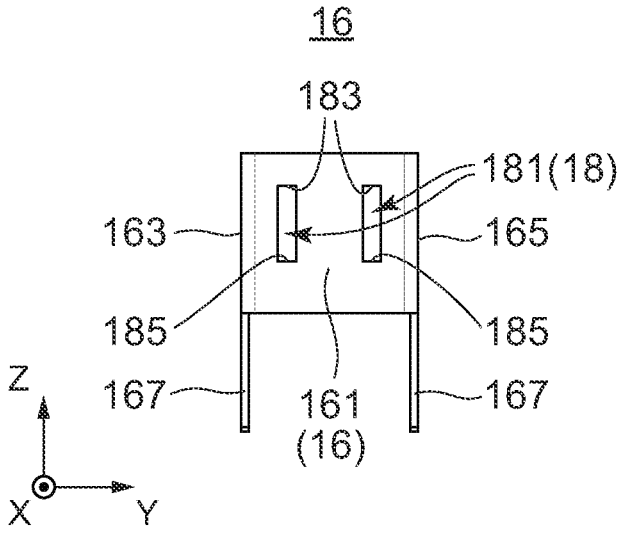
FIG. 12 is a side view showing the guide member of FIG. 10.

As shown in FIGS. 10 to 12, the supporting portions 163 and 165 have lengths different from each other in the pitch direction. Moreover, each of the supporting portions 163 and 165 is provided with leg portions 167 extending downward. However, the present invention is not limited thereto. The supporting portions 163 and 165 may have the same length as each other in the pitch direction. Moreover, each of the supporting portions 163 and 165 may not be provided with the leg portions 167. However, providing at least one leg portion 167 to one or each of the supporting portions 163 and 165 allows the guide member 16 to be directly fixed to the substrate 80 using the leg portion 167.

As understood from FIGS. 7 to 9, the guide members 16 correspond to the end faces 143 of the housing 14, respectively, and thereby the side portion 161 of each of the guide members 16 and the supporting portions 163 and 165 of each of the guide members 16 correspond to one of the end faces 143 of the housing 14. The guide members 16 are attached to both end portions of the housing 14 in the pitch direction. In detail, the supporting portions 163 and 165 are press-fit into the slits 145 of the housing 14, respectively, in part. As understood from FIGS. 3 and 8, at that time, the leg portion 167 provided to the supporting portion 163 is inserted into the hole (not shown) formed in the housing 14 and protrudes downward from a lower surface 147 of the housing 14 in part.

As shown in FIG. 7, in a state that the guide members 16 are attached to the housing 14, the guide members 16 protrude outward from both ends of the housing 14 in the pitch direction. In other words, the side portion 161 of each of the guide members 16 is located apart from the end face 143 corresponding thereto in the pitch direction. The side portion 161, the supporting portions 163 and 165 and the end face 143 corresponding to the side portion 161 form a receiving portion 169. The receiving portion 169 guides and receives the protruding block 56 corresponding to the end face 143 forming the receiving portion 169 when the connector 10 and the mating connector 50 are mated with each other.

As shown in FIG. 1, in the present embodiment, the locking portions 18 correspond to the guide members 16, respectively. In other words, the locking portions 18 are provided to the guide members 16, respectively. As shown in FIG. 12, each of the locking portions 18 is realized as two long holes 181 provided in the side portion 161 of the guide member 16 corresponding thereto. However, the present invention is not limited thereto. The locking portion 18 may be realized as one hole provided in the guide member 16. Alternatively, the locking portion 18 may be realized as one or more holes or recessed portions provided to the housing 14. Furthermore, the locking portion 18 may be realized as at least one protrusion or stop while the mating locking portion 60 may be realized as at least one hole or recessed portion which is engaged with the protrusion or the stop.

As understood from FIG. 12, each of the long holes 181 which serve as the locking portion 18 has an upper end 183 and a lower end 185 in the up-down direction. In other words, the locking portion 18 has a predetermined range defined by the upper ends 183 and the lower ends 185. In the present embodiment, the contact portions 121 of the terminals 12 (see FIG. 1) are located within the predetermined range in the up-down direction. By locating, in the up-down direction, the contact portions 121 of the terminals 12 within the predetermined range defined by the locking portions 18 in this way, a height of the connector 10 can be reduced. In detail, by getting the position of the locking portions 18 down as lower as possible in the up-down direction to locate the contact portions 121 within the predetermined range, the height of the connector 10 can be reduced.

Figure 2:
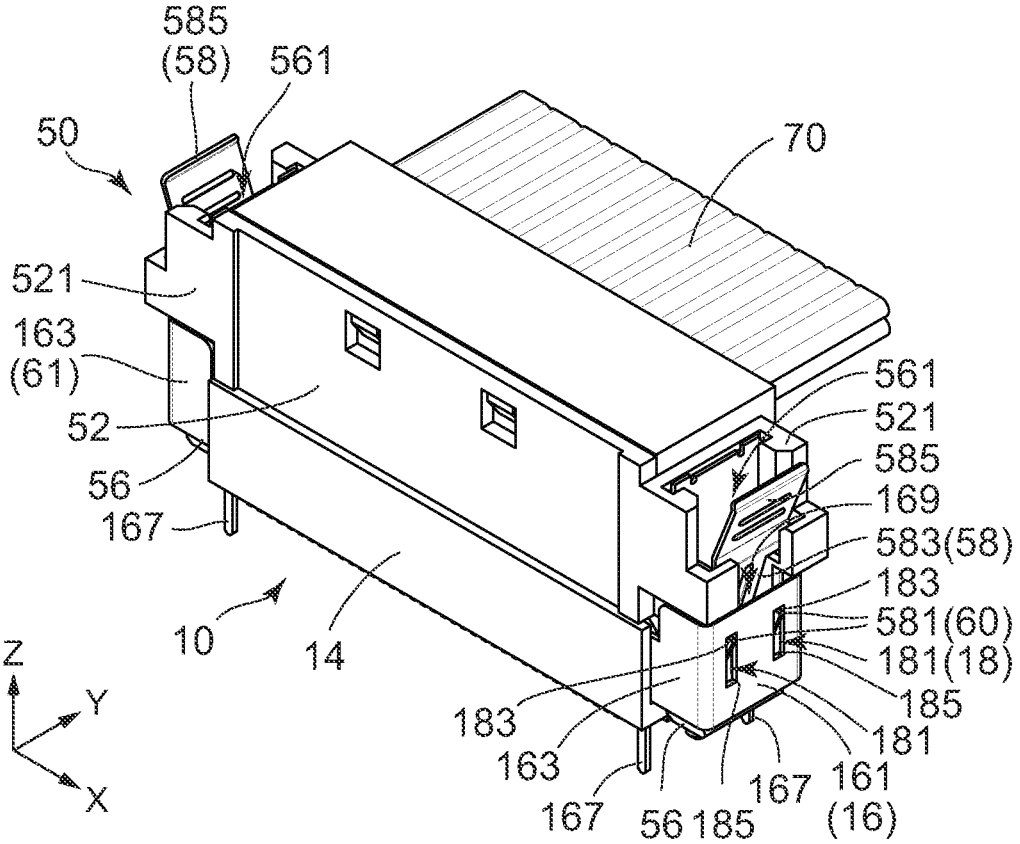
FIG. 2 is another perspective view showing the connector assembly of FIG. 1. The connector and the mating connector are mated with each other.
Figure 4:
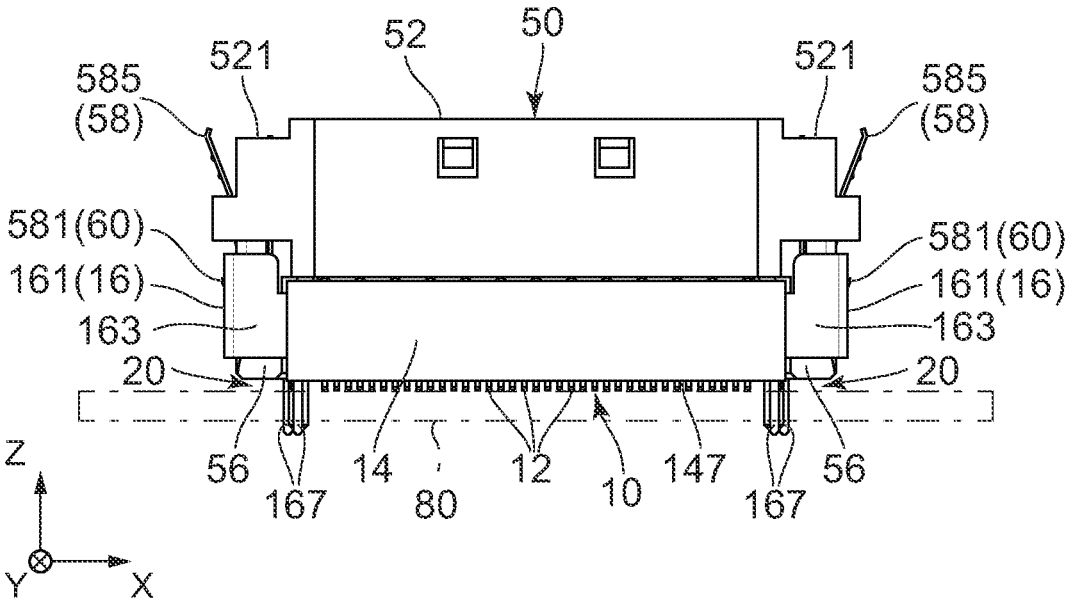
FIG. 4 is a front view showing the connector assembly of FIG. 2.

As understood from FIGS. 2 and 4, in the mated state that the connector 10 and the mating connector 50 are mated with each other, the locking portions 18 lock the mated state together with the mating locking portions 60. In the present embodiment, when the connector 10 and the mating connector 50 are mated with each other, the mating locking portions 60 are received by the locking portions 18 at least in part. Then, the mating locking portions 60 and the locking portions 18 are engaged with one another and lock the mated state. If the operation portions 585 of the locking springs 58 are operated to deform the supporting portions 583 resiliently, the locking of the mated state can be released.

As understood from FIGS. 3 and 4, when the connector 10 is mounted on the substrate 80, the side portion 161 of each of the guide members 16 and the supporting portions 163 and 165 of each of the guide members 16 are located apart from the substrate 80. In detail, the side portion 161 and the supporting portions 163 and 165 are located apart from and upward of the substrate 80 in the up-down direction. Thus, outside each of the end faces 143 of the housing 14 in the pitch direction and under the side portion 161 and the supporting portions 163 and 165 in the up-down direction, a lower space 20 is formed to communicate with the receiving portion 169 (see FIG. 7). Here, the leg portions 167 are located inward of the end faces 143 of the housing 14 in the pitch direction. Accordingly, the guide members 16 are not in the lower spaces 20 at all.

According to the present embodiment, the guide members 16 are not in the lower spaces 20 located downward of the guide members 16. Therefore, conductor patterns can be formed on an area of a mounting surface of the substrate 80 on which the connector 10 is mounted, wherein the area faces each of the lower spaces 20. Thus, a dead space of the mounding surface of the substrate 80 is reduced, and the mounting surface of the substrate 80 can be used effectively. Particularly, in a case where a plurality of connectors 10 is mounted on the substrate 80, continuous areas can be formed on the mounting surface of the substrate 80 by arranging the connectors 10 along the front-rear direction to arrange lower spaces 20 in the front-rear direction. And thereby the mounting surface of the substrate 80 can be used more effectively.

Moreover, since the two guide members 16 are distinct and separated from each other according to the present embodiment, the guide members 16 can be used for housings 14 with various shapes and sizes. In other words, the guide members 16 can be used as common parts for plurality types of connectors.

Second Embodiment

Referring to FIGS. 13 to 18, the description will be made about a connector 10A according to a second embodiment of the present invention. The same or similar components as those of the connector 10 according to the first embodiment are designated by the same reference numerals, and the description thereof will be omitted. Incidentally, a mating connector (not shown) which is mateable with and removable from the connector 10A has a shape different from that of the mating connector 50 (see FIG. 1).

Figure 13:
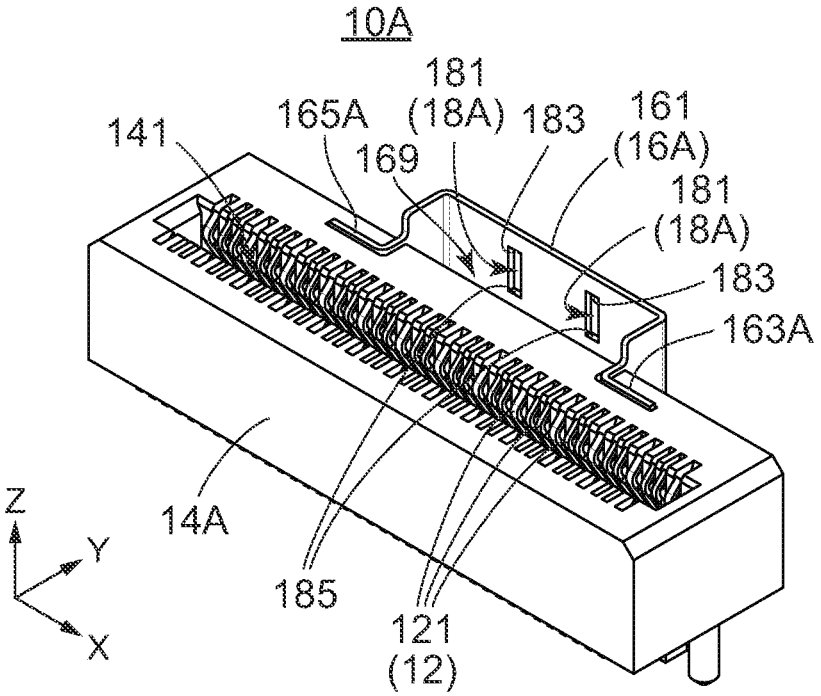
FIG. 13 is a perspective view showing a connector according to a second embodiment of the present invention.

Referring to FIG. 13, the connector 10A is provided with a plurality of terminals 12, a housing 14A, a guide member 16A and a locking portion 18A.

As understood from FIG. 13, the guide member 16A is attached to the housing 14A. The locking portion 18A corresponds to the guide member 16A. In the present embodiment, the locking portion 18A is realized as a pair of long holes 181 formed in the guide member 16A.

Figure 14:
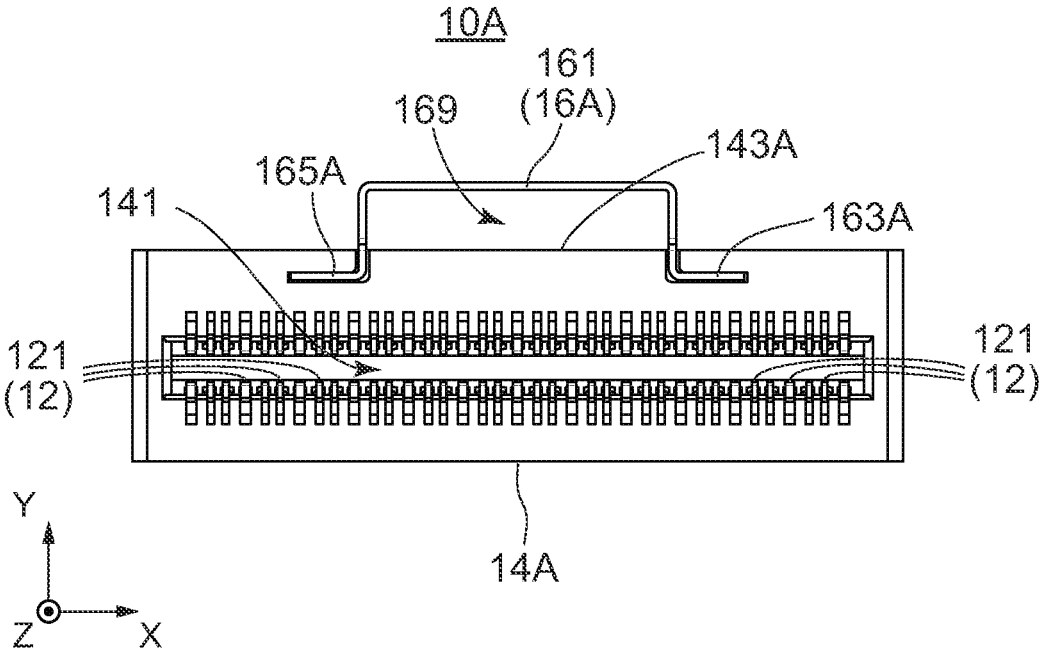
FIG. 14 is a top view showing the connector of FIG. 13.

As shown in FIG. 14, the housing 14A has an end face 143 in a perpendicular direction perpendicular to the up-down direction. In the present embodiment, the perpendicular direction coincides with the front-rear direction. The end face 143A is a surface directed outward in the perpendicular direction. In other words, the end face 143A is directed rearward in the front-rear direction.

As shown in FIG. 14, the guide member 16A is made from a metal sheet and has a side portion 161 and two supporting portions 163A and 165A supporting the side portion 161. The side portion 161 is a flat plate perpendicular to the front-rear direction. The supporting portions 163A and 165A have shapes which are mirror images of each other. Each of the supporting portions 163A and 165A extends forward in the front-rear direction from an edge of the side portion 161 in the pitch direction, and then extends outward in the pitch direction.

As understood from FIG. 14, the guide member 16A corresponds to the end face 143A of the housing 14A, and thereby the side portion 161A and the supporting portions 163A and 165A correspond to the end face 143A of the housing 14A. In a state that the guide member 16A is attached to the housing 14A, the guide member 16A protrudes rearward in the front-rear direction from the housing 14A. In other words, the side portion 161 of the guide member 16A is located apart from the end face 143A in the front-rear direction. The side portion 161, the supporting portions 163A and 165A and the end face 143A form a receiving portion 169. The receiving portion 169 receives a protruding block (not shown) when the connector 10 and the mating connector (not shown) are mated with each other.

Figure 15:
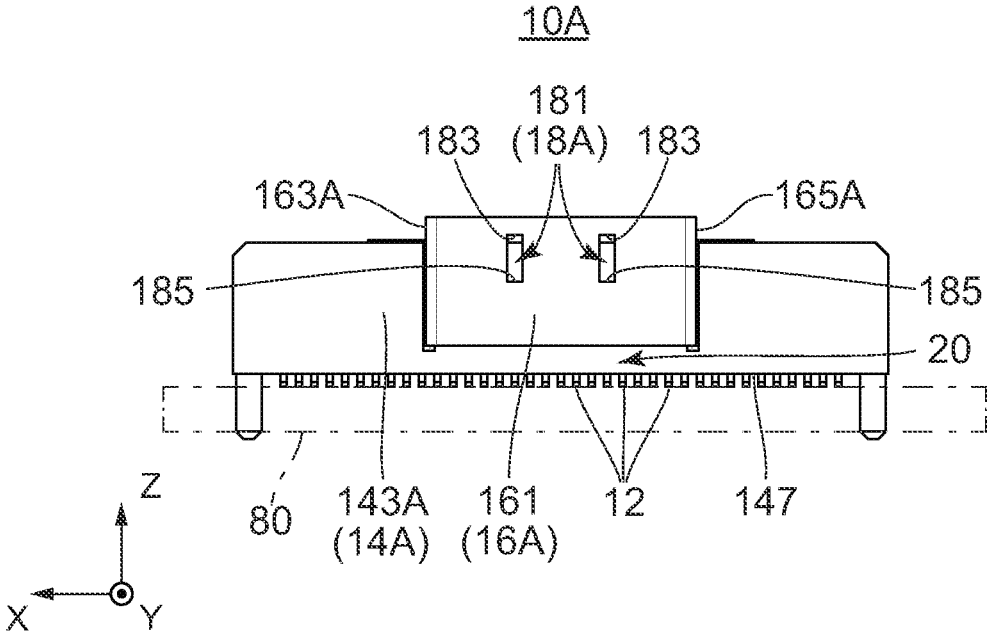
FIG. 15 is a rear view showing the connector of FIG. 13.

As shown in FIG. 15, in the present embodiment, the locking portion 18A is realized as the two long holes 181 provided in the side portion 161 of the guide member 16A. However, the present invention is not limited thereto. The locking portion 18A may be realized as one hole provided in the guide member 16A. Alternatively, the locking portion 18A may be realized as one or more holes or recessed portions provided to the housing 14A. Furthermore, the locking portions 18A may be realized as at least one protrusion or stop while the mating locking portions (not shown) may be realized as at least one hole or recessed portion which is engaged with the protrusion of the stop.

Figure 17:
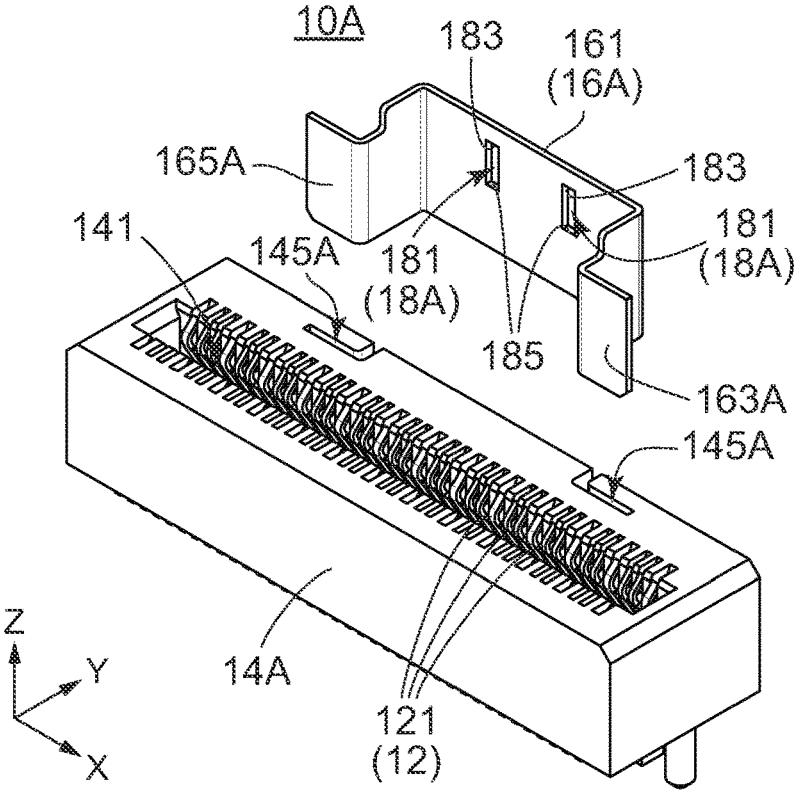
FIG. 17 is an exploded, perspective view showing the connector of FIG. 13.
Figure 18:
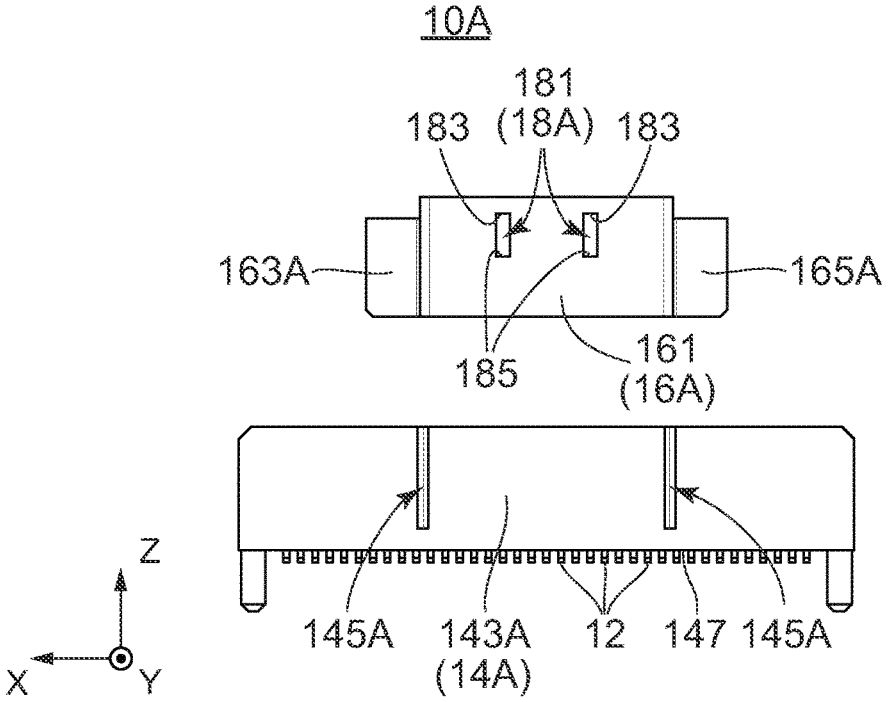
FIG. 18 is a rear view showing the connector of FIG. 17.

As shown in FIGS. 17 and 18, the housing 14A is formed with two slits 145A to be attached with the guide member 16A. Each of the slits 145A opens upward and rearward. The supporting portions 163A and 165A are inserted into the slits 145A of the housing 14A, respectively, so that the guide member 16A is attached to the housing 14A.

Figure 16:
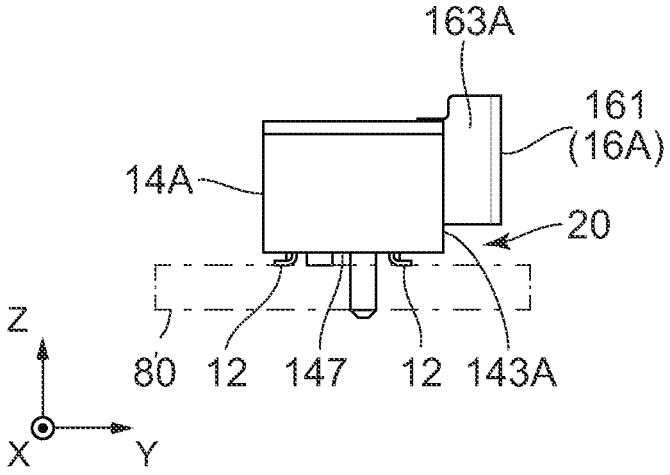
FIG. 16 is a side view showing the connector of FIG. 13.
Figure 19:
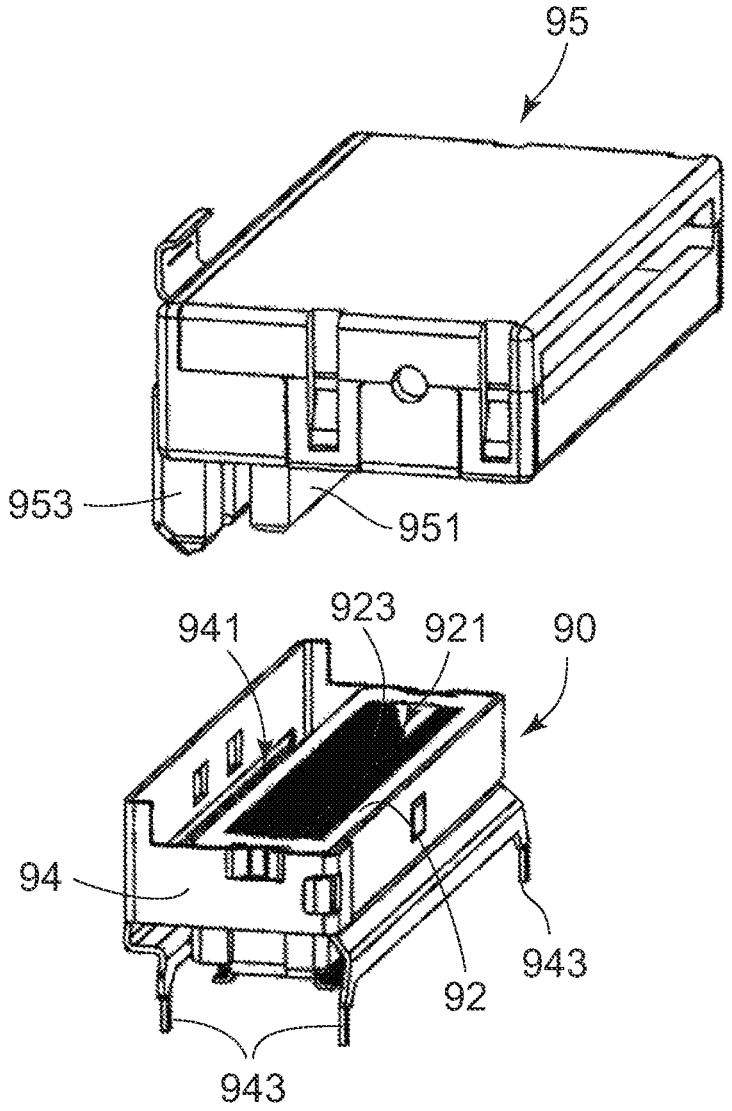
FIG. 19 PRIOR ART
FIG. 19 is a perspective view showing a connector assembly described in Patent Document 1.

As understood from FIGS. 15 and 16, when the connector 10A is mounted on the substrate 80, the side portion 161 of the guide member 16A and the supporting portions 163A and 165A of the guide member 16A are located apart from the substrate 80. In detail, the side portion 161 and the supporting portions 163A and 165A are located upward of and apart from the substrate 80 in the up-down direction. Thus, behind the end face 143A of the housing 14A in the front-rear direction and under the side portion 161 and the supporting portions 163A and 165A in the up-down direction, a lower space 20 is formed to communicate with the receiving portion 169 (see FIG. 19). And the guide member 16A is not in the lower space 20 at all.

As mentioned above, also in the connector 10A of the present invention, the guide member 16A is not in the lower space 20. Accordingly, similarly to the connector 10 of the first embodiment, a dead space of a mounting surface of the substrate 80 is reduced, and the mounting surface of the substrate 80 can be used effectively.

Although the specific explanation about the present invention is made above referring to the embodiments, the present invention is not limited thereto but susceptible of various modifications and alternative forms without departing from the spirit of the invention. For example, the housing 14 or 14A may be formed by a housing body and a metal shell or reinforcing metal portion which cover an outside of the housing body in part. In that case, the locking portion 18 may be provided to the metal shell or reinforcing metal portion. Moreover, the guide member 16 may be formed to be attached to the metal shell or reinforcing metal portion. Furthermore, the housing body and the metal shell or reinforcing metal portion may be integrally formed.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which is mateable with a mating connector along an up-down direction, wherein:

the connector is to be mounted on a substrate in the up-down direction;

the mating connector comprises a mating contact portion and a protruding block;

the protruding block protrudes along the up-down direction;

the protruding block is provided with a mating locking portion;

the connector comprises at least one terminal, a housing, at least one guide member and a locking portion;

the terminal has a contact portion;

the contact portion is brought into contact with the mating contact portion in a mated state that the connector and the mating connector are mated with each other;

the housing holds the terminal;

the housing has an end face in a perpendicular direction perpendicular to the up-down direction;

the locking portion locks the mated state together with the mating locking portion;

the guide member has a side portion and two supporting portions supporting the side portion;

the side portion is located apart from the end face of the housing in the perpendicular direction;

the end face of the housing, the side portion of the housing and the supporting portions of the housing form a receiving portion which guides and receives the protruding block when the connector and the mating connector are mated with each other;

the side portion and the supporting portions are located apart from the substrate when the connector is mounted on the substrate;

outside the end face of the housing in the perpendicular direction and under the side portion and the supporting portions in the up-down direction, a lower space is formed to communicate with the receiving portion; and the guide member is not located in the lower space.

2. The connector as recited in claim 1, wherein the locking portion is provided to the side portion.

3. The connector as recited in claim 1, wherein:

the at least guide member comprises two guide members; and the guide members protrude outward of both ends of the housing in the perpendicular direction.

4. The connector as recited in claim 3, wherein:

the at least one terminal is a plurality of terminals;

the terminals are arranged in the pitch direction;

the guide members are distinct and separated from each other; and the pitch direction is the perpendicular direction.

5. The connector as recited in claim 1, wherein:

the locking portion extends over a predetermined range in the up-down direction; and the contact portion of the terminal is located within the predetermined range in the up-down direction.

* * * * *